US009128412B2

(12) United States Patent
Leemhuis et al.

(10) Patent No.: US 9,128,412 B2
(45) Date of Patent: Sep. 8, 2015

(54) VENTING SYSTEM FOR A TONER CARTRIDGE FOR USE WITH AN IMAGE FORMING DEVICE

(71) Applicant: Lexmark International, Inc., Lexington, KY (US)

(72) Inventors: Michael Craig Leemhuis, Nicholasville, KY (US); James Richard Leemhuis, Lexington, KY (US); Charles Alan Bast, Winchester, KY (US); Kyle Benjamin Freels, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/320,726

(22) Filed: Jul. 1, 2014

(65) Prior Publication Data

US 2014/0369719 A1 Dec. 18, 2014

Related U.S. Application Data

(63) Continuation-in-part of application No. 13/936,425, filed on Jul. 8, 2013, now Pat. No. 8,774,685.

(60) Provisional application No. 61/834,903, filed on Jun. 14, 2013.

(51) Int. Cl.
*G03G 15/08* (2006.01)
*G03G 21/20* (2006.01)

(52) U.S. Cl.
CPC ..... *G03G 15/0865* (2013.01); *G03G 15/0896* (2013.01); *G03G 15/0875* (2013.01); *G03G 15/0898* (2013.01); *G03G 21/206* (2013.01)

(58) Field of Classification Search
CPC ..... G03G 15/0839; G03G 15/0896; G03G 15/0865; G03G 15/0875; G03G 15/0898; Y10S 222/01
USPC ..... 399/102, 106, 120, 258, 262, 263; 347/86, 214; D18/56
See application file for complete search history.

(56) References Cited

U.S. PATENT DOCUMENTS 4,469,436 A 9/1984 Jones et al.
4,955,316 A 9/1990 Asanuma et al.

(Continued)

FOREIGN PATENT DOCUMENTS

EP 1422577 A2 5/2004
JP 2002268517 A * 9/2002 ..... G03G 21/18

(Continued)

OTHER PUBLICATIONS

International Search Report and Written Opinion of the International Searching Authority dated Oct. 16, 2014 for PCT Application No. PCT/US2014/040481.

(Continued)

*Primary Examiner* — David Gray
*Assistant Examiner* — Laura Roth
(74) *Attorney, Agent, or Firm* — Justin M Tromp

(57) ABSTRACT

A toner cartridge for an electrophotographic image forming device according to one example embodiment includes a housing having a reservoir for storing toner. The toner cartridge includes a first vent having an inlet opening positioned to receive air from outside the housing, an outlet opening positioned to exit the received air into the reservoir, and a one-way valve that permits airflow through the first vent from the inlet opening to the outlet opening and prevents airflow through the first vent from the outlet opening to the inlet opening. A check valve limits airflow through the first vent from the inlet opening to the outlet opening.

17 Claims, 15 Drawing Sheets

(56) References Cited

U.S. PATENT DOCUMENTS

| | | | | |
|---|---|---|---|---|
| 5,012,289 | A | 4/1991 | Aldrich et al. | |
| 5,089,852 | A | 2/1992 | Manno et al. | |
| 5,109,254 | A | 4/1992 | Oka et al. | |
| 5,221,945 | A | 6/1993 | Smith | |
| 5,260,750 | A | 11/1993 | Ishida et al. | |
| 5,414,499 | A | 5/1995 | Yahata | |
| 5,434,654 | A | 7/1995 | Nagai | |
| 5,485,187 | A | 1/1996 | Okamura et al. | |
| 5,526,030 | A | 6/1996 | Baldwin et al. | |
| 5,758,231 | A | 5/1998 | Coffey et al. | |
| 6,315,011 | B1 | 11/2001 | Smith | |
| 6,778,801 | B1 | 8/2004 | Dougherty | |
| 6,931,224 | B2 | 8/2005 | Foster et al. | |
| 7,548,710 | B2 | 6/2009 | Gayne et al. | |
| 7,606,520 | B2 | 10/2009 | Dawson | |
| 8,000,636 | B2 | 8/2011 | Sano | |
| 8,768,223 | B2 | 7/2014 | Leemhuis et al. | |
| 8,774,685 | B1 | 7/2014 | Leemhuis et al. | |
| 2001/0041083 | A1 | 11/2001 | Terazawa et al. | |
| 2001/0051062 | A1 | 12/2001 | Yanagisawa et al. | |
| 2002/0131789 | A1 * | 9/2002 | Yokoi et al. | 399/103 |
| 2003/0053826 | A1 | 3/2003 | Bares et al. | |
| 2003/0170049 | A1 | 9/2003 | Itoh et al. | |
| 2005/0105931 | A1 | 5/2005 | Foster et al. | |
| 2005/0244193 | A1 | 11/2005 | Amano et al. | |
| 2005/0286936 | A1 * | 12/2005 | Huang et al. | 399/262 |
| 2006/0239722 | A1 | 10/2006 | Tanaka et al. | |
| 2007/0003325 | A1 | 1/2007 | Jung et al. | |
| 2008/0226311 | A1 | 9/2008 | Senoh et al. | |
| 2009/0245881 | A1 | 10/2009 | Schlageter et al. | |
| 2011/0279592 | A1 | 11/2011 | Hibbard et al. | |
| 2012/0243900 | A1 | 9/2012 | Schroeder et al. | |
| 2012/0301187 | A1 | 11/2012 | Ishikuro et al. | |
| 2013/0170862 | A1 | 7/2013 | Leemhuis et al. | |
| 2013/0170871 | A1 | 7/2013 | Buchanan et al. | |

FOREIGN PATENT DOCUMENTS

| | | | | |
|---|---|---|---|---|
| JP | 2003208003 A * | 7/2003 | | G03G 15/08 |
| JP | 2006-39017 | 2/2006 | | |

OTHER PUBLICATIONS

U.S. Appl. No. 14/280,733, filed May 19, 2014.

"Supplies Marketing Bulletin—Announcing Supplies for the New Lexmark MS310, MS410, MS510 and MS610 Monochrome Laser Printers" by Lexmark International, Inc. dated Oct. 18, 2012.

"Supplies Marketing Bulletin—Announcing Supplies for the New Lexmark MS810, MS811 and MS812 Monochrome Laser Printers" by Lexmark International, Inc. dated Oct. 18, 2012.

"Supplies Marketing Bulletin—Announcing Supplies for the New Lexmark MX310, MX410, MX510, MX511, MX610 and MX611 Laser Multifunction Printers" by Lexmark International, Inc. dated Oct. 18, 2012.

"Supplies Marketing Bulletin—Announcing Supplies for the New Lexmark MX710, MX711, MX810, MX811 and MX812 Laser Multifunction Printers" by Lexmark International, Inc. dated Oct. 18, 2012.

International Search Report and Written Opinion of the International Searching Authority dated Jan. 28, 2013 for PCT Application No. PCT/US12/65144.

* cited by examiner

VENTING SYSTEM FOR A TONER CARTRIDGE FOR USE WITH AN IMAGE FORMING DEVICE

CROSS REFERENCES TO RELATED APPLICATIONS

This patent application is a continuation-in-part application of U.S. patent application Ser. No. 13/936,425, filed Jul. 8, 2013, entitled "Venting System for a Toner Cartridge for use with an Image Forming Device," which claims priority to U.S. Provisional Patent Application Ser. No. 61/834,903, filed Jun. 14, 2013, entitled "Venting System for a Toner Cartridge for Use with an Image Forming Device," the contents of which are hereby incorporated by reference in their entirety.

BACKGROUND

1. Field of the Disclosure

The present disclosure relates generally to image forming devices and more particularly to a venting system for a toner cartridge for use with an image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

Toner is moved from a toner reservoir in the toner cartridge through an outlet port on the toner cartridge into an inlet port on the corresponding imaging unit. A relatively air tight seal is often desired around the outlet port of the toner cartridge in order to prevent toner from leaking as it moves from the toner cartridge to the imaging unit. As toner is fed from the toner cartridge, a low pressure or vacuum-like condition may be created in the toner cartridge as toner is removed and air cannot enter to fill the void. Further, as toner enters the imaging unit, air may be displaced creating a high pressure condition in a toner reservoir of the imaging unit. If the pressure gradient between the reservoirs of the imaging unit and the toner cartridge is too large, toner flow from the toner cartridge to the imaging unit may be restricted causing the toner flow rate to become inconsistent and unpredictable. This can lead to failures such as incorrect cartridge empty determination or starvation of the imaging unit. Accordingly, a venting system that aids toner flow from the toner cartridge to the imaging unit is desired.

SUMMARY

A toner cartridge for an electrophotographic image forming device according to one example embodiment includes a housing having a reservoir for storing toner. The toner cartridge includes a first vent having an inlet opening positioned to receive air from outside the housing, an outlet opening positioned to exit the received air into the reservoir, and a one-way valve that permits airflow through the first vent from the inlet opening to the outlet opening and prevents airflow through the first vent from the outlet opening to the inlet opening. A check valve limits airflow through the first vent from the inlet opening to the outlet opening.

A toner cartridge for an electrophotographic image forming device according to another example embodiment includes a housing having a reservoir for storing toner. The toner cartridge includes a first vent having an inlet opening on an outer side of a wall of the housing positioned to receive air from outside the housing, an outlet opening on an inner side of the wall of the housing positioned to exit the received air into the reservoir, and a one-way valve that permits airflow through the first vent from the inlet opening to the outlet opening and prevents airflow through the first vent from the outlet opening to the inlet opening. A check valve is open to the inlet opening in a normal operating position of the check valve permitting air to enter the inlet opening. The check valve closes the inlet opening when the airflow through the first vent from the inlet opening to the outlet opening exceeds a threshold amount.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
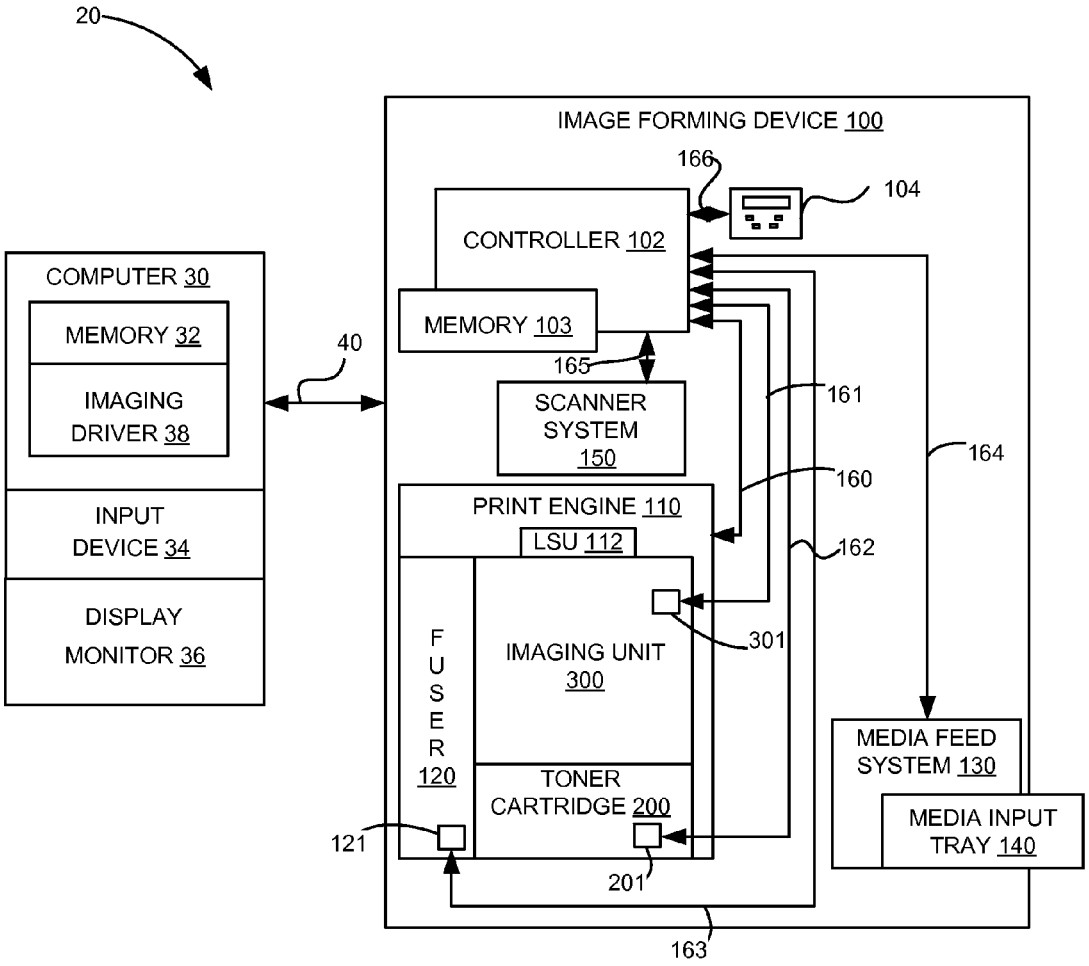
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
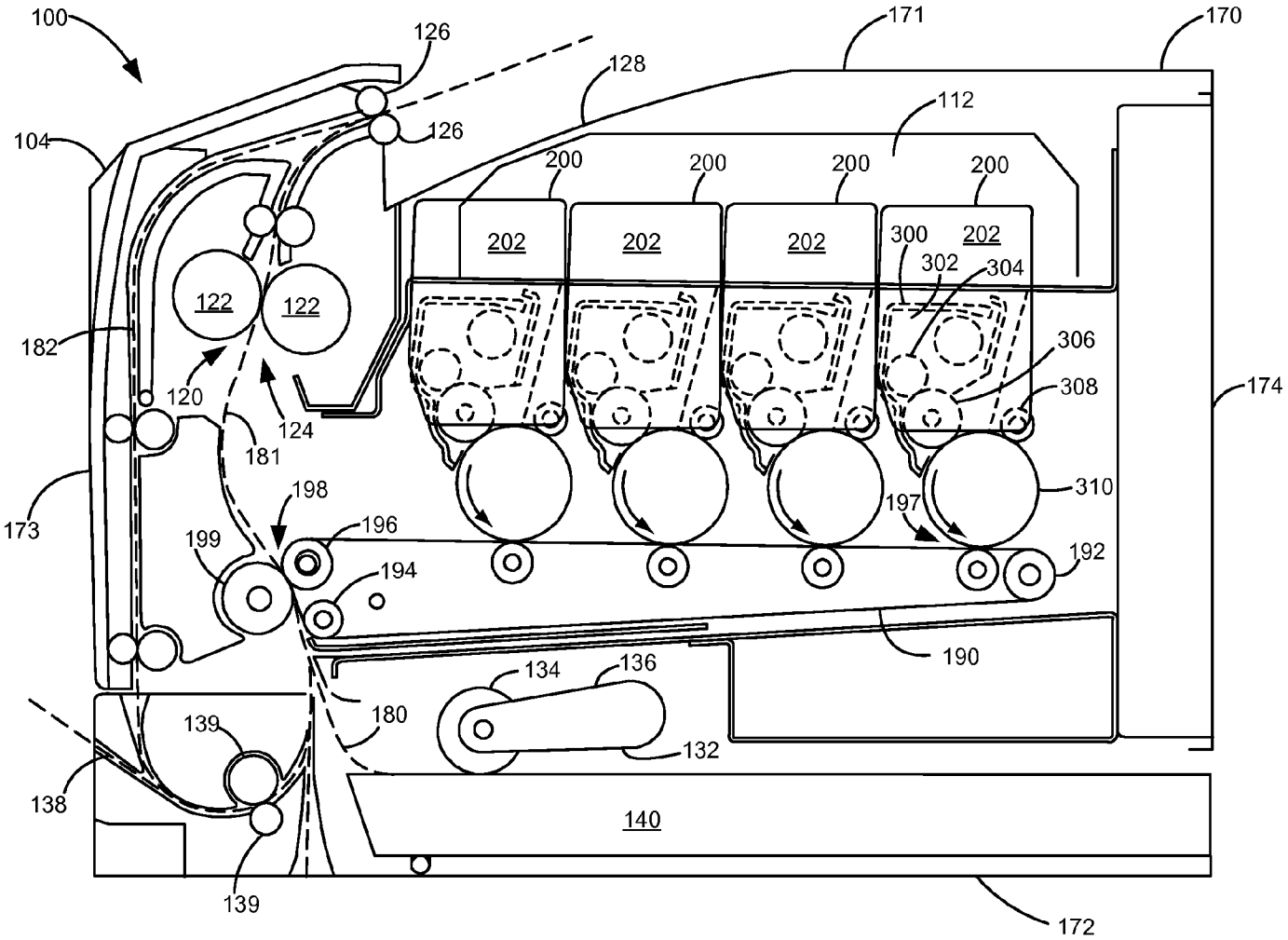
FIG. 2 is a schematic diagram of an image forming device according to a first example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174.

Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage 10 to such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations. ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
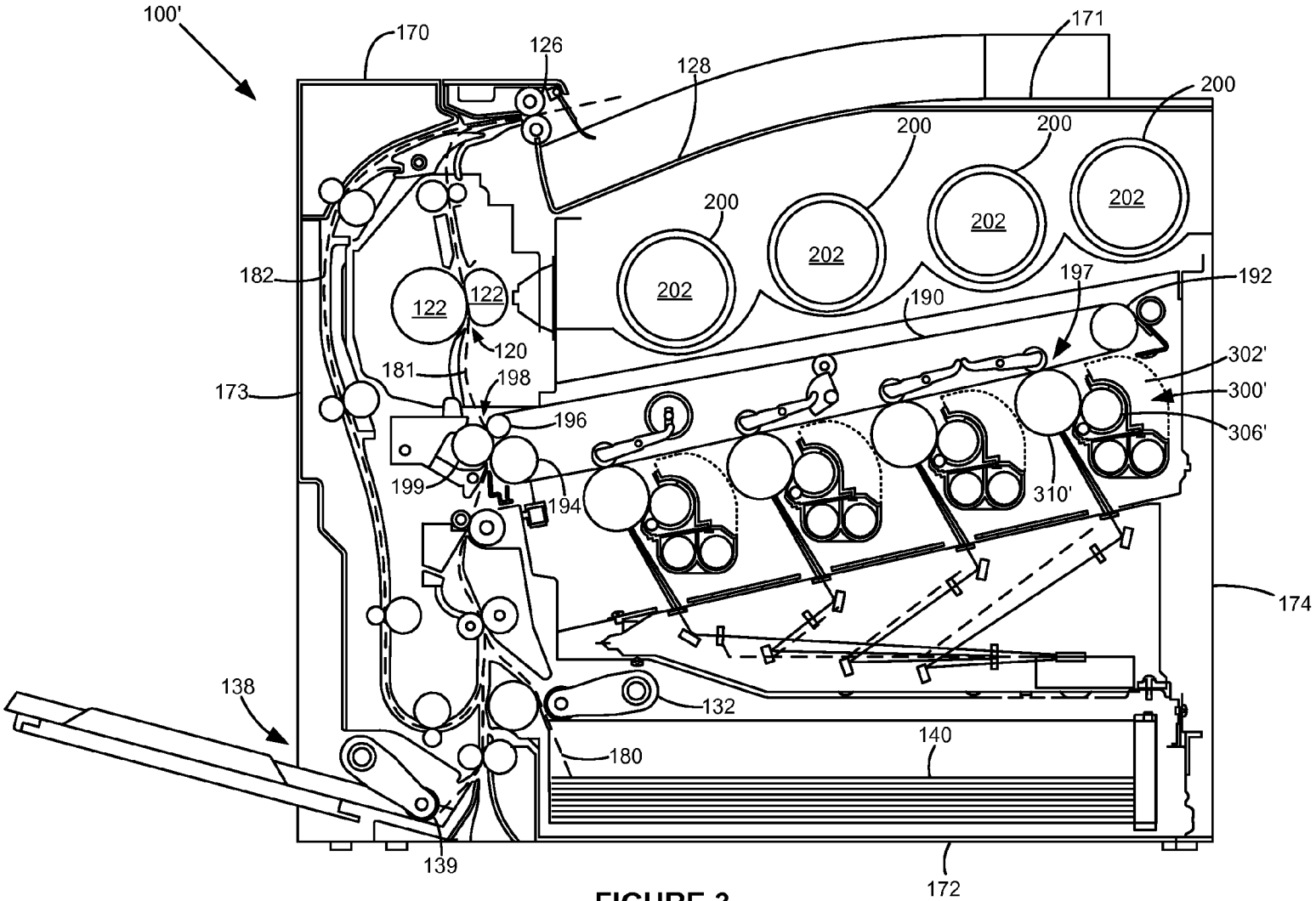
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although imaging forming devices 100 and 100' utilize ITM 190 to transfer toner to the media, toner may be applied directly to the media by the one or more photoconductive drums 310, 310' as is known in the art. In addition, toner may be transferred directly from each toner cartridge 200 to its corresponding imaging unit 300 or 300' or the toner may pass through an intermediate component such as a chute or duct that connects the toner cartridge 200 with its corresponding imaging unit 300 or 300'.

Figure 4:
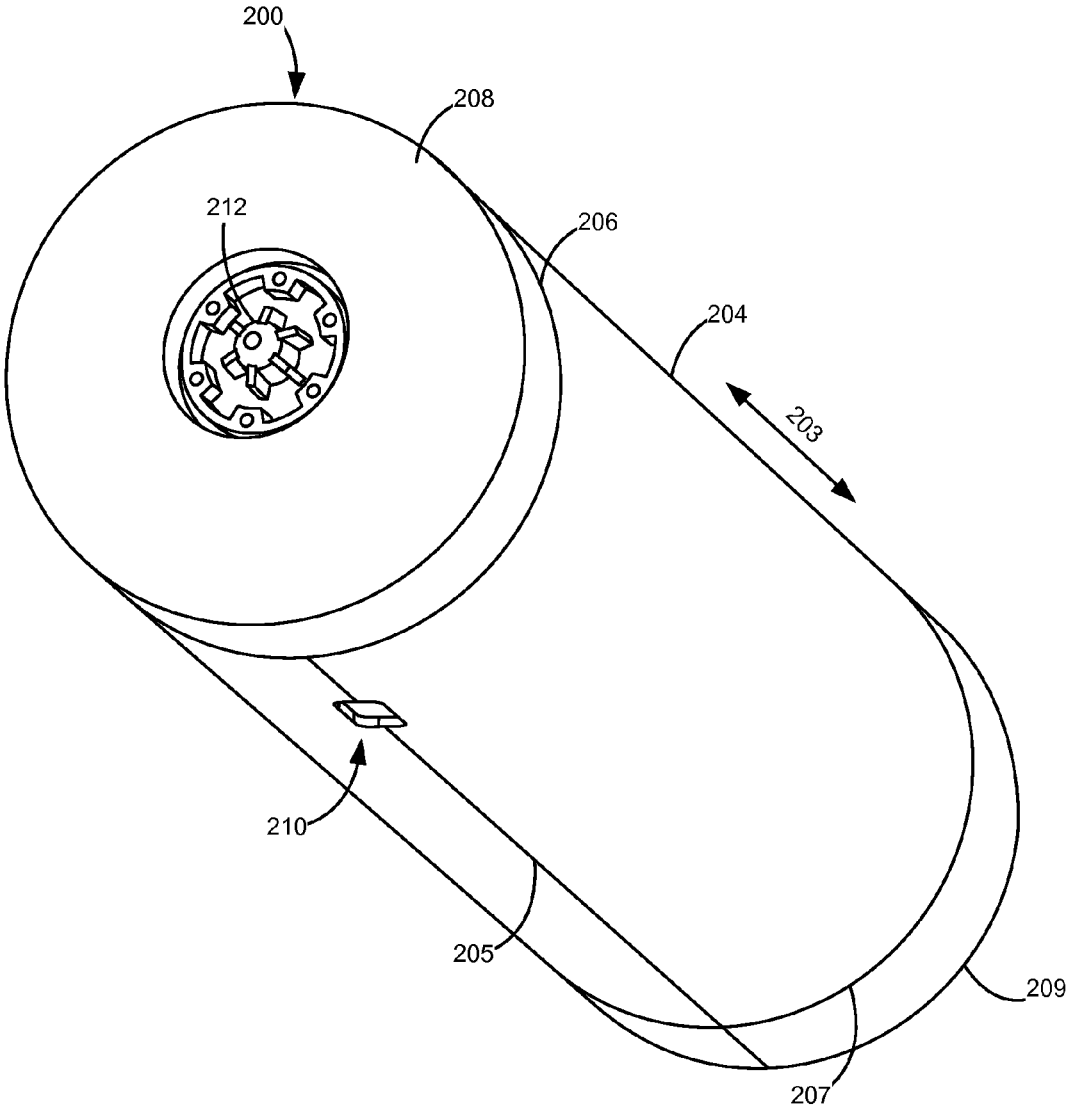
FIG. 4 is a perspective end view of a toner cartridge according to one example embodiment.

With reference to FIG. 4, toner cartridge 200 is shown according to one example embodiment. Toner cartridge 200 includes a body 204 that includes walls forming toner reservoir 202 (FIGS. 2 and 3). In the example embodiment illustrated, body 204 includes a generally cylindrical wall 205 and a pair of end walls 206, 207. However, body 204 may include any suitable shape or dimensions. In the embodiment illustrated, end caps 208, 209 are mounted on end walls 206, 207, respectively such as by suitable fasteners (e.g., screws, rivets, etc.) or by a snap-fit engagement. An outlet port 210 is positioned on a bottom portion of body 204 such as near end wall 206. Toner is periodically delivered from reservoir 202 through outlet port 210 to reservoir 302 of imaging unit 300 to refill reservoir 302 as toner is consumed by the printing process. As desired, outlet port 210 may include a shutter or a cover that is movable between a closed position blocking outlet port 210 to prevent toner from flowing out of toner cartridge 200 and an open position permitting toner flow. In some embodiments, the shutter or cover forms a relatively airtight seal against outlet port 210 when the shutter or cover is in the closed position to prevent toner leakage. Toner cartridge 200 includes one or more agitators 15 (e.g., paddles, augers, etc.) to stir and move toner within reservoir 202. In one embodiment, the agitator(s) are driven by one or more rotatable shafts positioned within reservoir 202. In the example embodiment illustrated, a drive element 212, such as a gear or other form of drive coupler, is positioned on an outer surface of end wall 206. A portion of drive element 212 is exposed through end cap 208 in order to allow drive element 212 to receive rotational force from a corresponding drive component in the image forming device when toner cartridge 200 is installed in the image forming device. The rotatable shaft(s) within reservoir 202 may be connected directly or by one or more intermediate gears to drive element 212.

Figure 5:
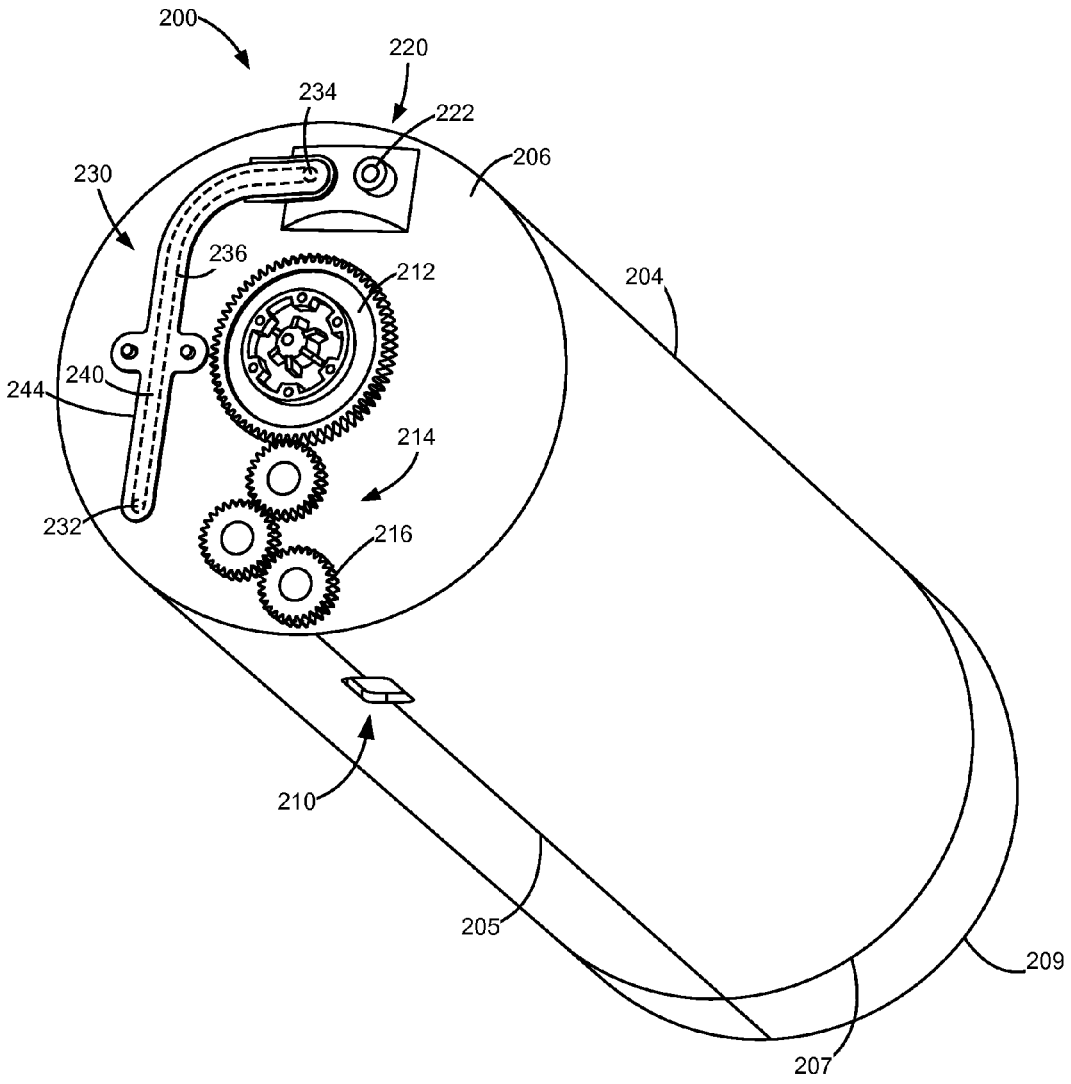
FIG. 5 is a perspective end view of the toner cartridge shown in FIG. 4 with an end cap of the toner cartridge removed.

With reference to FIG. 5, toner cartridge 200 is shown with end cap 208 removed to more clearly illustrate the outer side of end wall 206. In the example embodiment illustrated, toner cartridge 200 includes a gear train 214, which may include one or more idler gears, positioned on end wall 206 beneath end cap 208 that leads from drive element 212 to a driven gear 216. In this embodiment, driven gear 216 receives rotational force from drive element 212 through gear train 214 and provides rotational force to an agitator positioned adjacent to outlet port 210 within reservoir 202 as discussed in greater detail below.

Figure 6:
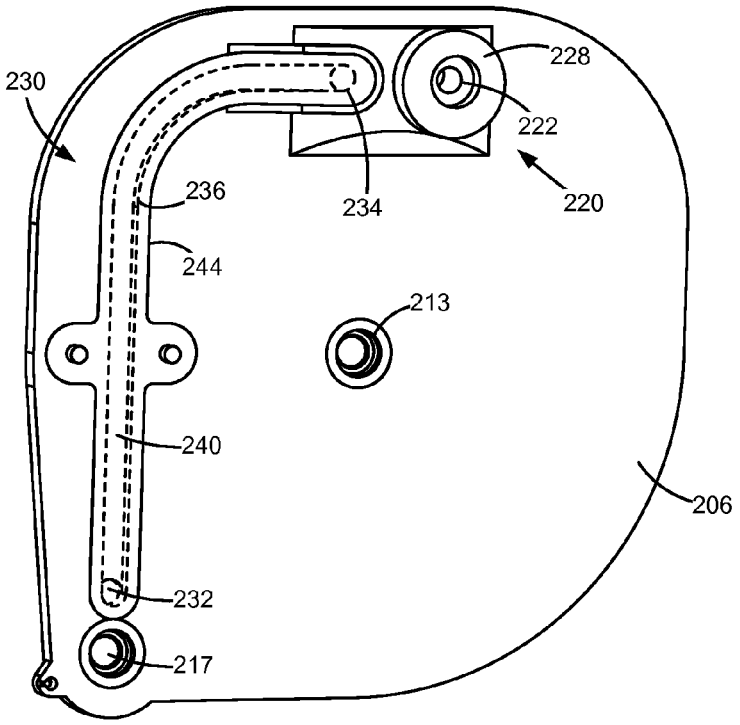
FIG. 6 is a side elevation view of the outer side of an end wall of a toner cartridge according to a first example embodiment.

With reference to FIG. 6, the outer side of end wall 206 according to one example embodiment is shown with drive element 212, gear train 214 and driven gear 216 removed for clarity. FIG. 6 shows through holes 213 and 217 that receive rotatable shafts from reservoir 202 to permit the shafts to couple with drive element 212 and driven gear 216, respectively. Through holes 213 and 217 each include a gasket or the like to seal the interfaces between end wall 206 and the rotatable shafts so that toner from reservoir 202 does not leak from through holes 213 and 217. Although two through holes are shown in FIG. 6, any number of through holes may be present depending on the number of rotatable shafts in reservoir 202 requiring a connection to a drive element on end wall 206.

Figure 7:
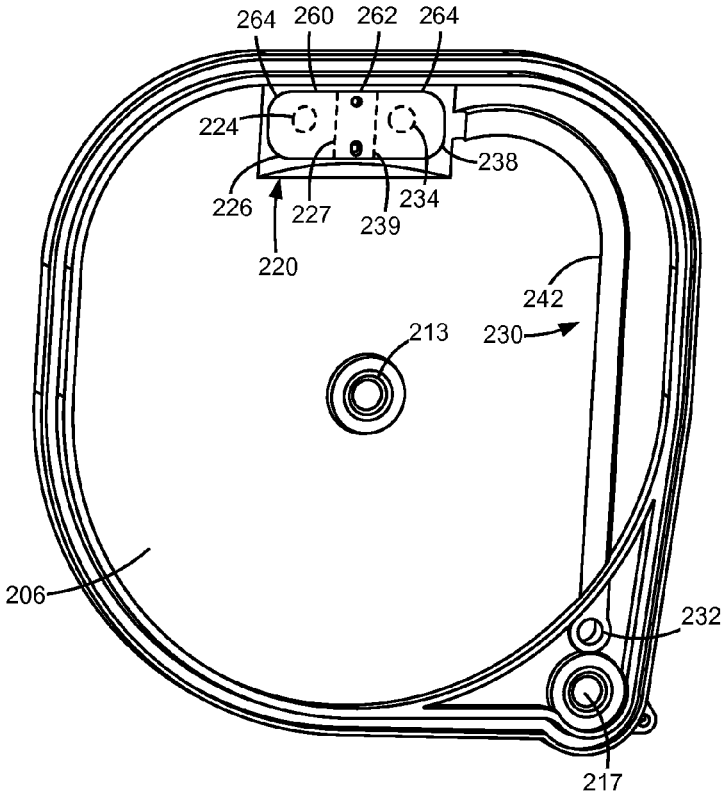
FIG. 7 is a side elevation view of the inner side of the end wall shown in FIG. 6.

Toner cartridge 200 includes a vent 220 that permits the introduction of outside air into reservoir 202 in order to maintain nearly atmospheric pressure in reservoir 202. This prevents the low pressure or vacuum-like condition that may occur when toner exits toner cartridge 200 without air entering to fill the void. Vent 220 includes an inlet opening 222 positioned on the outer side of end wall 206. With reference to FIG. 7, the inner side of end wall 206 is shown. An outlet opening 224 (shown in dashed lines) in communication with inlet opening 222 is positioned on the inner side of end wall 206. For simplicity, in this embodiment, outlet opening 224 and inlet opening 222 are substantially aligned with each other, however, they may be offset and connected by a channel or duct as desired. In one embodiment, inlet opening 222 and outlet opening 224 are on the order of 3 mm to 4 mm in diameter. Inlet opening 222 and outlet opening 224 are shown as circular but may be any suitable shape. Vent 220 includes a one-way valve that permits air to enter reservoir 202 from outside toner cartridge 200 and prevents air and toner from exiting reservoir 202 through vent 220. For example, in the embodiment shown, a flap formed from flexible plastic film commonly referred to as a reed valve 226 covers outlet opening 224. For example, reed valve 226 may be formed from a polyethylene terephthalate (PET) material such as MYLAR® available from DuPont Teijin Films, Chester, Va., USA. The flexible plastic film may be adhered to end wall 206, for example, using adhesive and/or stakes. In operation, when the air pressure in reservoir 202 is less than the atmospheric pressure, the flap of reed valve 226 flexes away from the inner side of end wall 206 to permit air to enter reservoir 202 from outside toner cartridge 200 through vent 220. When the air pressure in reservoir 202 is greater than the atmospheric pressure, the flap of reed valve 226 seals against the inner side of end wall 206 to prevent air from exiting reservoir 202 through vent 220. In the example embodiment illustrated, reed valve 226 flexes about pivot line 227. In the embodiment illustrated, outlet opening 224 is positioned in an uppermost portion of reservoir 202 so that during operation of toner cartridge 200 the toner level will generally be below outlet opening 224 so that the toner does not restrict air flow through vent 220. Although inlet opening 222 and outlet opening 224 are illustrated positioned on end wall 206 in the example embodiment illustrated, it will be appreciated that vent 220 including inlet opening 222 and outlet opening 224 may be positioned at any suitable location on toner cartridge 200 including, for example, cylindrical wall 205.

Figure 8:
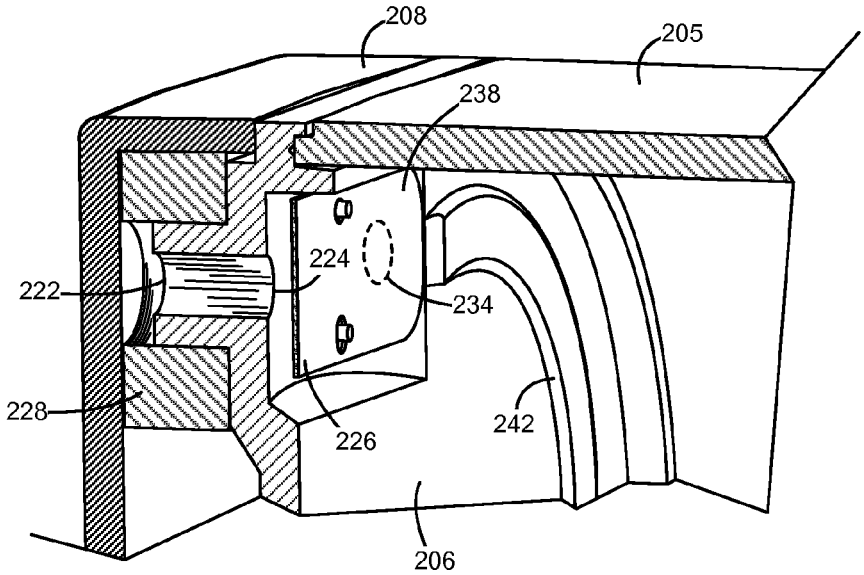
FIG. 8 is a cross-sectional view of the end wall and the end cap of the toner cartridge shown in FIG. 6 illustrating an air filter according to one example embodiment.

With reference to FIGS. 6 and 8, in one embodiment, vent 220 includes an air filter 228 positioned at inlet opening 222 to collect any small amount of toner that leaks past reed valve 226 of vent 220. In one embodiment, air filter 228 is composed of open cell foam. In the embodiment shown, air filter 228 is positioned around inlet opening 222 and is sandwiched between the outer side of end wall 206 and the inner side of end cap 208. In this manner, end cap 208 prevents toner from escaping air filter 228. In operation, the amount of air flow through vent 220 depends on the pressure differential between reservoir 202 and atmospheric pressure, the sizes of inlet opening 222 and outlet opening 224 and the resistance to air flow caused by air filter 228 (if present) and the one-way valve such as reed valve 226.

With reference back to FIG. 7, toner cartridge 200 includes a vent 230 that permits relatively high pressure air from reservoir 302 of imaging unit 300 to flow into the air cavity above the toner stored in reservoir 202. This prevents a large pressure gradient from forming between reservoir 302 and reservoir 202. Such a pressure gradient may restrict the flow of toner from reservoir 202 to reservoir 302. Without vent 230, air entering outlet port 210 from imaging unit 300 may not be able to flow to reservoir 202 because the air flow may be restricted by toner being fed to outlet port 210. Vent 230 includes an inlet opening 232 positioned on the inner side of end wall 206 next to outlet port 210 to receive air entering outlet port 210 from imaging unit 300. Inlet opening 232 is in communication with an outlet opening 234 (shown in dashed lines) positioned on an inner side of end wall 206. In the example embodiment illustrated, inlet opening 232 is in communication with outlet opening 234 via a channel or duct 236 (see FIG. 6) that runs through end wall 206. In one embodiment, inlet opening 232 and outlet opening 234 are on the order of 3 mm to 4 mm in diameter. Inlet opening 232 and outlet opening 234 are shown as circular but may be any suitable shape. Vent 230, like vent 220, includes a one-way valve that permits air to enter reservoir 202 and prevents air and toner from exiting reservoir 202 through vent 230. In the example embodiment shown, a reed valve 238 covers outlet opening 234. When the air pressure in reservoir 202 is less than the air pressure at outlet port 210 as a result of a relatively high pressure condition in reservoir 302 of imaging unit 300, the flap of reed valve 238 flexes away from the inner side of end wall 206 to permit air to enter reservoir 202 through vent 230. Conversely, when the air pressure in reservoir 202 is greater than the air pressure at outlet port 210, the flap of reed valve 238 seals against the inner side of end wall 206 to prevent air from exiting reservoir 202 through vent 230. In the example embodiment illustrated, reed valve 238 flexes about pivot line 239. In the example embodiment illustrated, reed valve 238 and reed valve 226 are formed from a single piece of plastic film 260 for simplicity and ease of manufacture; however, reed valves 226 and 238 may also be formed to separately as desired. In the embodiment illustrated, film 260 includes an adhesive portion 262 that adheres film 260 to end wall 206 and non-adhesive portions 264 that form the flaps of reed valves 226 and 238. In this embodiment, outlet opening 234 is positioned in an uppermost portion of reservoir 202 so that during operation of toner cartridge 200 the toner level will generally be below outlet opening 234 so that the toner does not restrict air flow through vent 230. Although inlet opening 232 and outlet opening 234 are illustrated as positioned on end wall 206 in the example embodiment illustrated, it will be appreciated that vent 230 including inlet opening 232 and outlet opening 234 may be positioned at any suitable location on toner cartridge 200 including, for example cylindrical wall 205.

Figure 9:
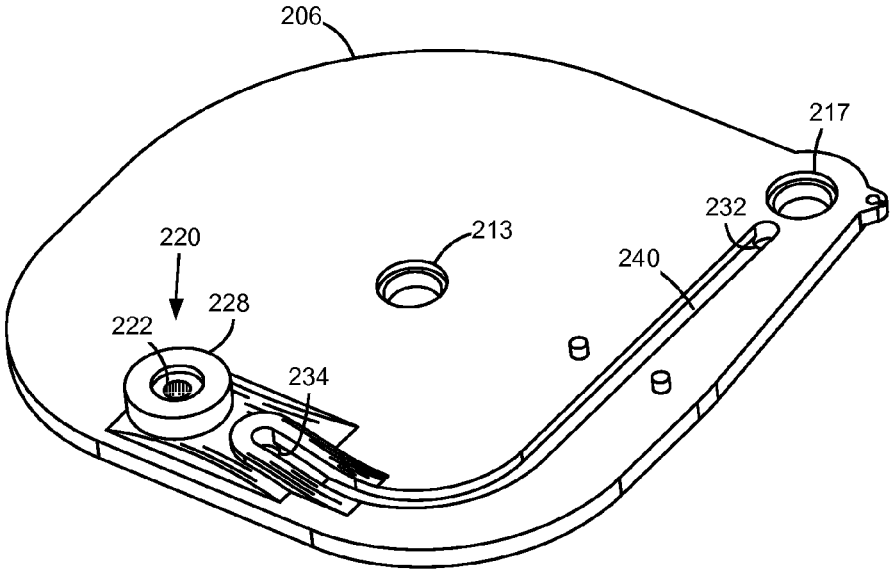
FIG. 9 is a perspective view of the outer side of the end wall shown in FIG. 6 with a seal removed.

With reference back to FIG. 6, in the example embodiment illustrated, duct 236 includes a recess 240 (shown in dashed lines) in the outer side of end wall 206 that connects inlet opening 232 with outlet opening 234, which are shown in dashed lines in FIG. 6. In one embodiment, a projection 242 corresponding to recess 240 is formed on the inner side of end wall 206 as shown in FIG. 7. As desired, duct 236 may be formed as a recess in the inner side of end wall 206 instead of the outer side of end wall 206. In the example embodiment illustrated, duct 236 includes a seal 244 that covers recess 240 so that air passing through recess 240 does not escape. FIG. 9 shows the outer side of end wall 206 shown in FIG. 6 with seal 244 removed to more clearly illustrate recess 240. The seal may be composed of any suitable material such as a flexible plastic film adhesively adhered to end wall 206 (e.g., MYLAR® mentioned above). Alternatively, duct 236 may be formed as a void within the material that makes up end wall 206, which may be, for example, a substantially rigid molded plastic. Further, it will be appreciated that duct 236 may take many other shapes and forms such as a rubber or plastic tube or pipe, etc. so long as duct 236 creates an air path from inlet opening 232 to outlet opening 234. In the example embodiment illustrated, duct 236 runs from a corner of end wall 206 where inlet opening 232 is located upward along a side portion of end wall 206 toward the top of body 204. Duct 236 then turns and runs toward a central, uppermost portion of end wall 206 where outlet opening 234 is located. However, it will be appreciated that duct 236 may take any suitable path to connect inlet opening 232 to outlet opening 234 including passing within and/or outside of reservoir 202 through any of walls 205, 206, 207.

Figure 10:
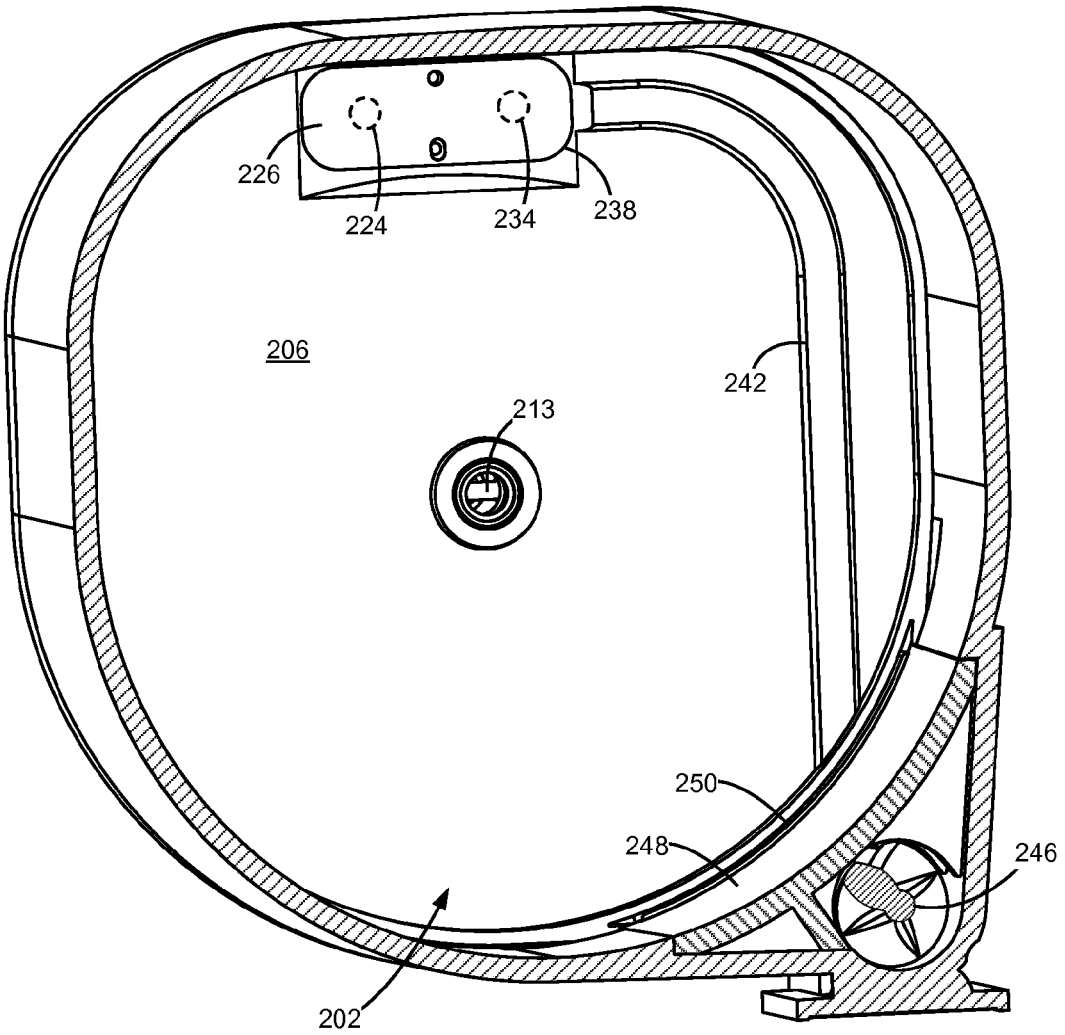
FIG. 10 is a cross-sectional view of a toner reservoir of the toner cartridge shown in FIG. 6 according to one example embodiment.
Figure 11:
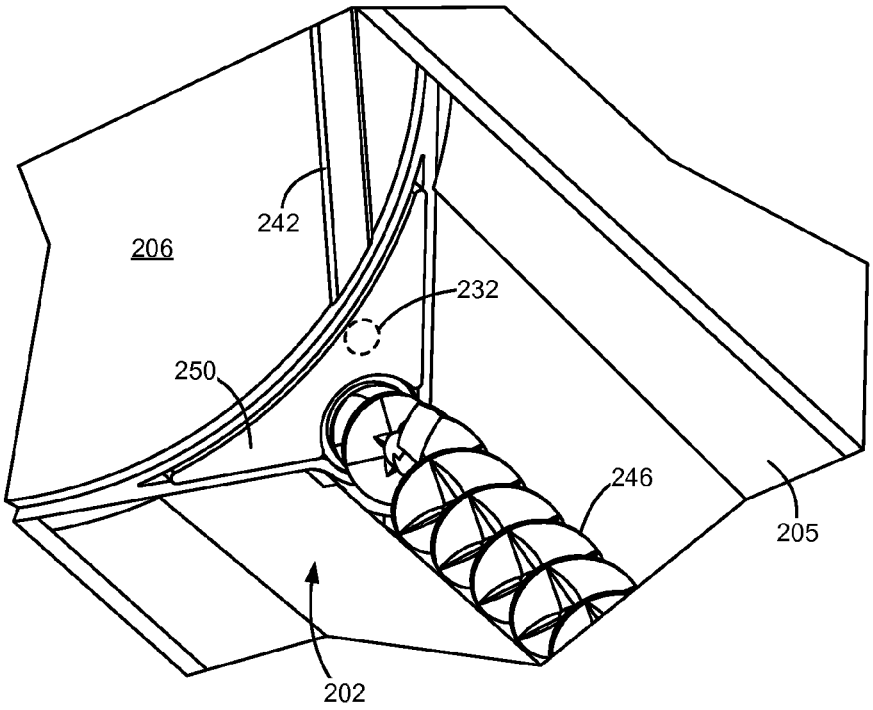
FIG. 11 is a perspective view of an interior of the toner reservoir shown in FIG. 10 with an auger deflector removed.
Figure 12:
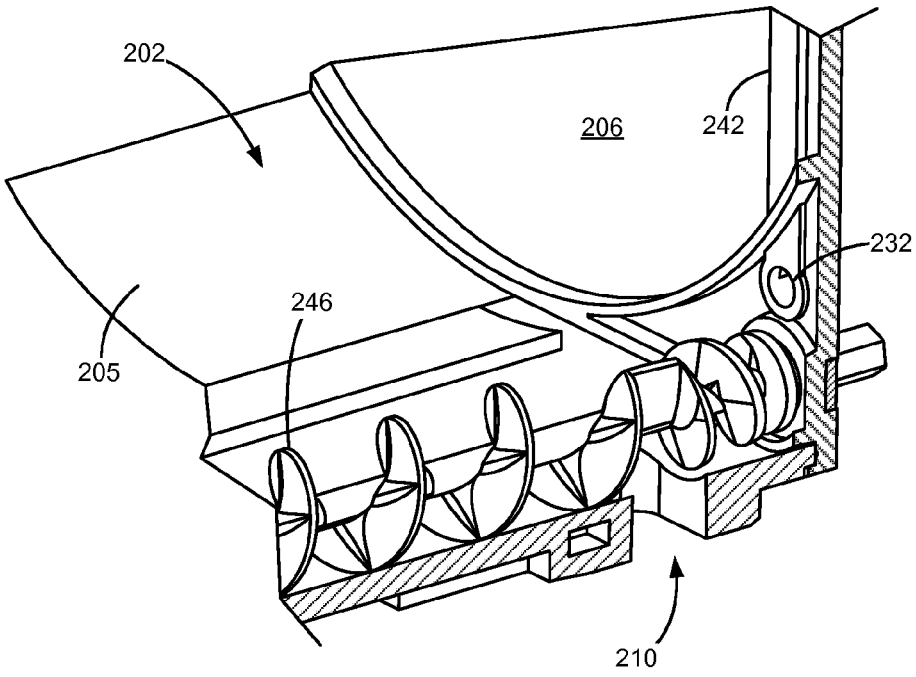
FIG. 12 is a cross-sectional view of the interior of the toner reservoir shown in FIGS. 10 and 11 showing the position of an auger relative to an outlet port of the toner cartridge according to one embodiment.

FIG. 10 shows a portion of reservoir 202 of toner cartridge 200 according to one example embodiment. In this embodiment, an auger 246 is positioned in a lower portion of reservoir 202 above outlet port 210 and has an axis of rotation generally orthogonal to end wall 206. Auger 246 receives rotational force from driven gear 216 to feed toner from reservoir 202 out of outlet port 210. In one embodiment, a deflector 248 separates a portion of auger 246 along the length of auger 246 from the toner stored in reservoir 202 to permit auger 246 to meter the amount of toner that exits outlet port 210. FIG. 11 is a perspective view from the interior of reservoir 202 looking toward end wall 206 and cylindrical wall 205 with deflector 248 removed to more clearly illustrate inlet opening 232 (shown in dashed lines). In this embodiment, inlet opening 232 is positioned adjacent to auger 246 (e.g., just above auger 246 as illustrated) and separated from the toner stored in reservoir 202 by deflector 248. In this position, air from reservoir 302 is permitted to pass up through outlet port 210 and into inlet opening 232. The air may then travel through duct 236 to open reed valve 238 and exit outlet opening 234. In the example embodiment illustrated, a foam seal 250 is positioned over inlet opening 232 to allow air to enter inlet opening 232 but reduce the amount of toner entering inlet opening 232. Seal 250 may also be positioned to prevent toner from passing between the inside of end wall 206 and deflector 248. FIG. 12 shows reservoir 202 with deflector 248 and seal 250 removed to more clearly illustrate the position of auger 246 relative to outlet port 210 according to one embodiment. In operation, the amount of air flow through vent 230 depends on the pressure differential between reservoir 302 and reservoir 202, the sizes of inlet opening 232 and outlet opening 234 and the resistance to air flow caused by duct 236, the one-way valve such as reed valve 238 and seal 250 (if present).

Some embodiments of toner cartridge 200 include a venting system that includes both vent 220 and vent 230. In these embodiments, the air pressure in reservoir 202 is generally the greater of atmospheric pressure and the pressure of reservoir 302, which is typically substantially equal to or greater than atmospheric pressure. Vent 230 permits air pressure from reservoir 302 above atmospheric pressure to pass to reservoir 202 in order to maintain pressure equilibrium between reservoir 202 and reservoir 302. Vent 220 prevents the air pressure in reservoir 202 from falling below atmospheric pressure. In this manner, the combination of vents 220 and 230 promotes consistent toner flow from reservoir 202 out of outlet port 210. Further, it may be desired to measure the amount of toner remaining in reservoir 202 based on the number of revolutions of the toner agitator(s) (e.g., auger 246) within reservoir 202 (e.g., based on the number of revolutions of drive element 212). For example, the amount of toner consumed may 10 to be determined by multiplying the number of revolutions by an amount of toner consumed per revolution (which may be determined empirically). The amount of toner remaining may then be determined by subtracting the amount of toner consumed from the initial amount of toner present in reservoir 202. If the toner is kept at near constant density (e.g., by fluffing or agitating the toner) and the air pressure within reservoir 202 is controlled, it has been found that the flow rate of toner from reservoir 202 decreases substantially linearly as the toner level decreases when the toner is metered through outlet port 210 using auger 246 and deflector 248. The combination of vent 220 and vent 230 helps maintain a predictable flow rate of toner from toner cartridge 200 and, as a result, permits the measurement of the amount of toner remaining in reservoir 202 based on agitator revolutions with improved accuracy in comparison with a reservoir 202 that experiences a vacuum-like condition encountered as toner is removed from reservoir 202 or that experiences a large pressure differential with a corresponding reservoir 302.

Figure 13:
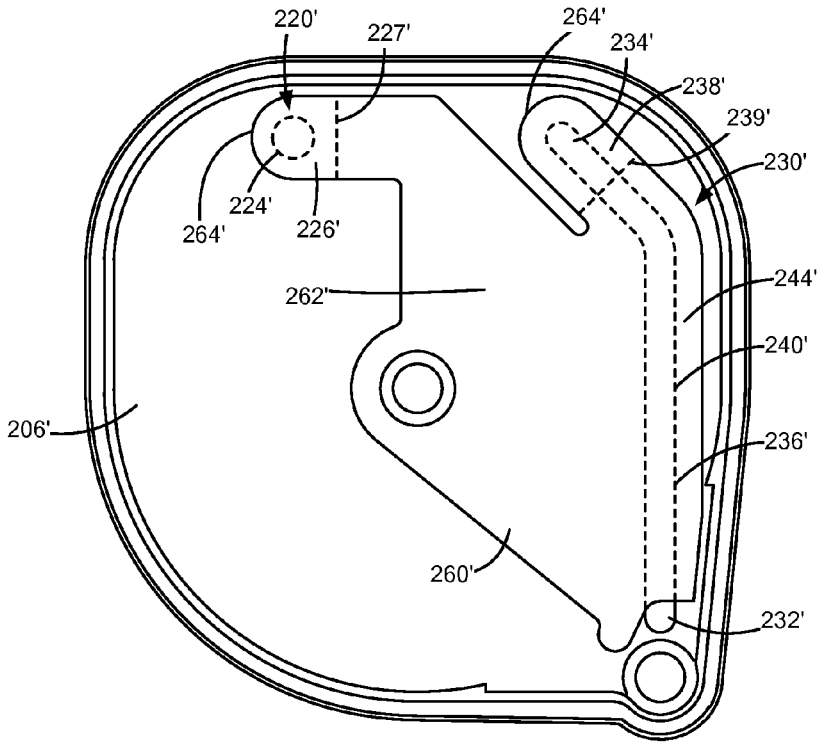
FIG. 13 is a side elevation view of the inner side of an end wall of a toner cartridge according to a second example embodiment.
Figure 14:
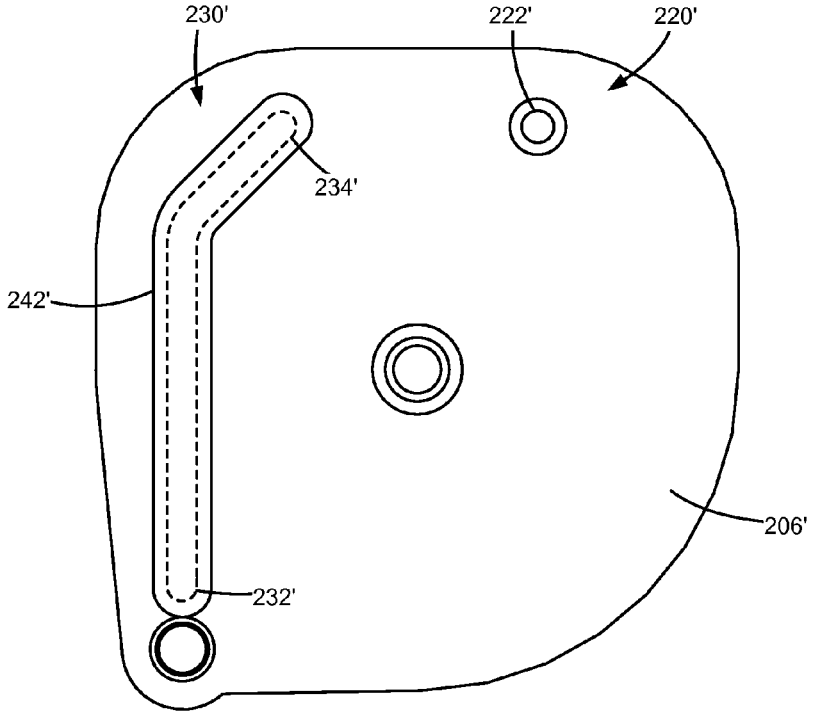
FIG. 14 is a side elevation view of the outer side of the end wall shown in FIG. 13.
Figure 15:
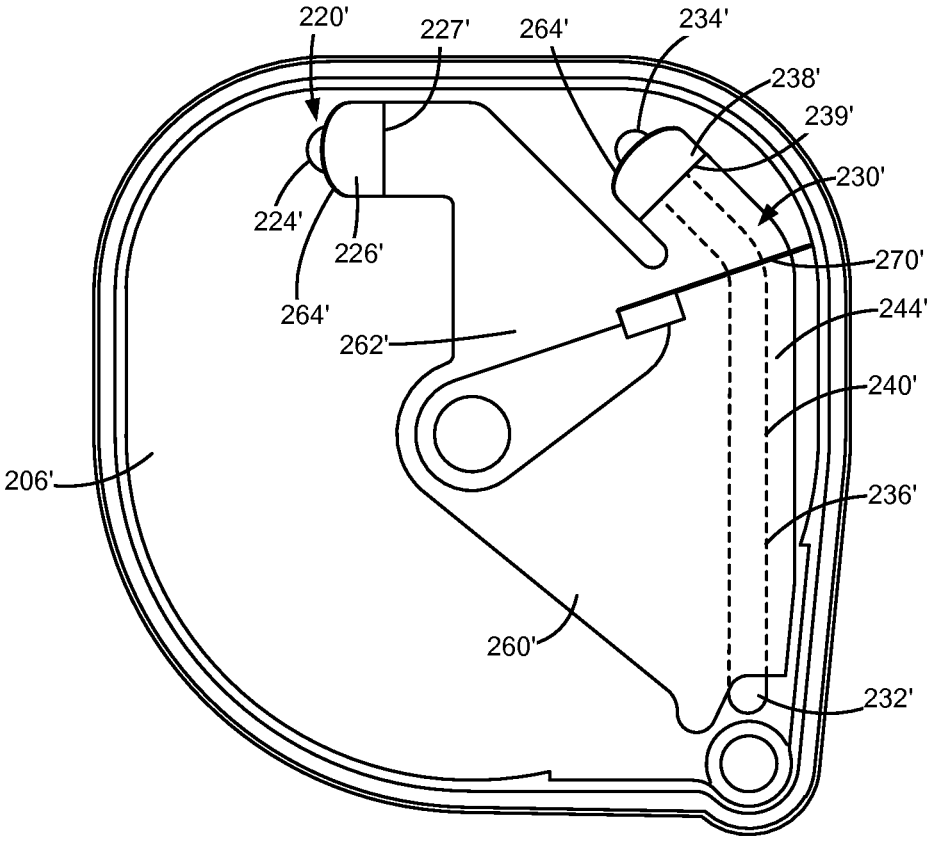
FIG. 15 is a side elevation view of the inner side of the end wall of the toner cartridge shown in FIG. 13 showing a pair of reed valves in their open positions relative to the rotation of a toner agitator.

FIGS. 13-15 illustrate another example embodiment of vents 220 and 230 labeled vents 220' and 230'. Specifically, FIGS. 13 and 15 show the inner side of an end wall 206' and FIG. 14 shows the outer side of end wall 206'. FIGS. 13 and 15 show outlet opening 224' of vent 220' and both inlet opening 232' and outlet opening 234' of vent 230' positioned on the inner side of end wall 206'. FIG. 14 shows inlet opening 222' of vent 220' positioned on the outer side of end wall 206'. In this example embodiment, duct 236' of vent 230' includes a recess 240' in the inner side of end wall 206' as shown in FIGS. 13 and 15. In this example, a projection 242' corresponding to recess 240' is formed on the outer side of end wall 206' as shown in FIG. 14. A seal 244' covers recess 240' to form duct 236'. In this example embodiment, a single piece of flexible plastic film 260' may be used to form seal 244' as well as reed valve 226' of vent 220' and reed valve 238' of vent 230' thereby reducing manufacturing complexity and cost. For example, film 260' may include an adhesive portion 262' that adheres film 260' to end wall 206 and non-adhesive portions 264' that form the flaps of reed valves 226' and 238'. In this embodiment, reed valve 226' flexes about pivot line 227' and reed valve 238' flexes about pivot line 239'. As illustrated in FIG. 15, reed valves 226' and 238' flex open from left to right as viewed in FIG. 15. This allows a toner agitator 270' to pass along the inner surface of end wall 206' in a counterclockwise direction as viewed in FIG. 15 with reduced risk that the agitator 270' will inadvertently open reed valve 226' or 238' thereby preventing toner leakage through vent 220' or 230'. If, on the other hand, toner agitator 270' contacts reed valve 226' or 238' in the direction that reed valve 226' or 238' flexes open, the agitator 270' may tend to inadvertently push reed valve 226' or 238' open as the agitator 270' passes or, worse yet, bend or deform reed valve 226' or 238' permanently opening the valve and allowing toner to leak through vent 220' or 230'.

In some instances, a user may be tempted to shake toner cartridge 200 causing toner to shift within reservoir 202. For example, a user may shake toner cartridge 200 to estimate the amount of toner remaining in reservoir 202 or to manually mix the toner in reservoir 202. If a user shakes toner cartridge 200 vigorously, in some embodiments that include a vent, such as vent 220 or 220', that permits the introduction of outside air into reservoir 202 and a one-way valve, such as reed valve 226 or 226', that prevents air from exiting reservoir 202 through the vent, toner may shift away from the outlet opening of the vent compressing the air inside reservoir 202 away from the outlet opening of the vent and creating a low pressure condition near the outlet opening of the vent. The pressure differential between the outside air pressure and the low pressure condition near the outlet opening of the vent causes outside air to enter reservoir 202 through the vent and the one-way valve thereby increasing the total internal air pressure in reservoir 202. The increased pressure is not able to escape reservoir 202 through the one-way valve(s) associated with the vent(s), such as vents 220, 220', 230 and 230', and is instead trapped inside reservoir 202 until the shutter or cover at outlet port 210 is opened. As a result, when the shutter or cover opens, the pressurized air escapes reservoir 202 through outlet port 210 carrying toner with it. If toner cartridge 200 is installed in image forming device 100 when this occurs, the toner exiting with the air enters the inlet port of imaging unit 300 resulting in an excess toner delivery from toner cartridge 200 to imaging unit 300. Alternatively, if toner cartridge 200 is outside of image forming device 100 when the pressurized air escapes outlet port 210, the toner carried out of reservoir 202 by the air may spill onto the user or surrounding surfaces resulting in uncleanliness. If toner cartridge 200 does not include a shutter or cover on outlet port 210, shaking toner cartridge 200 in a manner that increases the total internal air pressure in reservoir 202 causes the pressurized air to exit toner cartridge 200 through outlet port 210 carrying toner with it, again potentially spilling onto the user or surrounding surfaces.

Accordingly, in some embodiments, vent 220 or 220' that permits the introduction of outside air into reservoir 202 includes a check valve that limits the flow of air through vent 220, 220' into reservoir 202 in order to prevent a large influx of outside air through vent 220, 220' such as may occur during vigorous shaking of toner cartridge 200. For example, in one embodiment, inlet opening 222, 222' includes an air flow limiting filter, which may be positioned in the same manner as air filter 228 discussed above, that has a high resistance to air flow in order to limit the flow of air into vent 220, 220'. The resistance to air flow may be controlled by the material of the air flow limiting filter and/or the surface area of the air flow 15 limiting filter.

Figure 16:
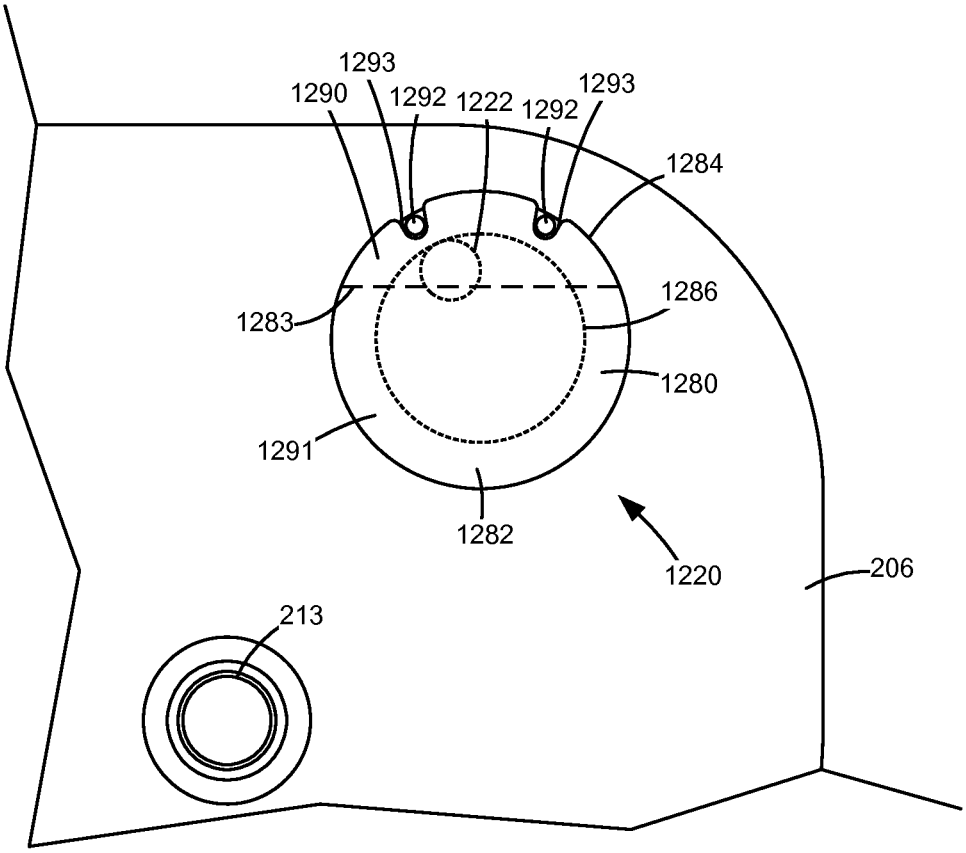
FIG. 16 is a side elevation view of an outer side of an end wall of a toner cartridge according to a third example embodiment having a check valve in the form of a reed valve.
Figure 17:
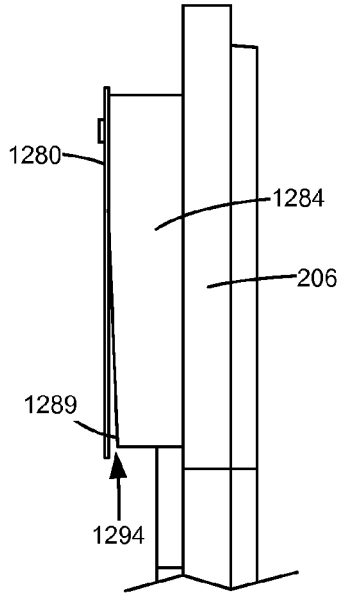
FIG. 17 is an elevation view of the outer side of the end wall shown in FIG. 16 rotated ninety degrees with respect to the view shown in FIG. 16.
Figure 18:
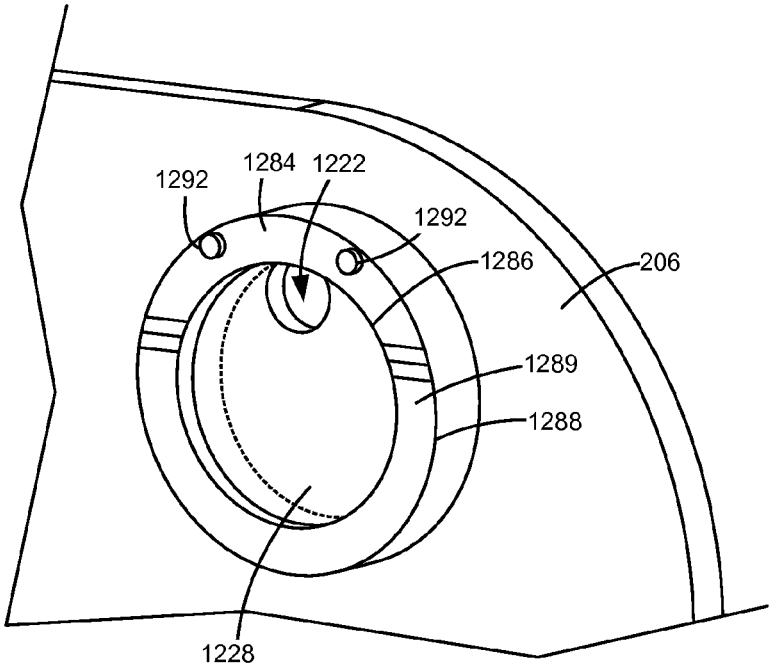
FIG. 18 is a perspective view of the outer side of the end wall shown in FIGS. 16 and 17 with the reed valve removed and illustrating an air filter according to one example embodiment.

FIGS. 16-18 illustrate another example embodiment of a vent 1220 that permits the introduction of outside air into reservoir 202. With reference to FIG. 16, vent 1220 includes an inlet opening 1222 positioned on the outer side of end wall 206. Like vents 220 and 220' discussed above, vent 1220 includes an outlet opening (not shown) in an interior portion of reservoir 202 and a one-way valve, such as a reed valve, that permits air to enter reservoir 202 from outside toner cartridge 200 and prevents air and toner from exiting reservoir 202 through vent 1220. Vent 1220 also includes a check valve that limits the flow of air through vent 1220 into reservoir 202 in order to prevent a large influx of outside air through vent 1220. For example, in the embodiment illustrated, vent 1220 includes a reed valve 1280 formed from a flexible plastic film and having a flap 1282 that covers inlet opening 1222. Specifically, with reference to FIGS. 16-18, in the example embodiment illustrated, a barrier such as a cylinder 1284 surrounds inlet opening 1222 on an outer side of end wall 206. Cylinder 1284 includes an opening 1286. Reed valve 1280 is mounted on an outer rim 1288 of cylinder 1284 with flap 1282 extending across opening 1286. In this embodiment, reed valve 1280 includes an adhesive portion 1290 that adheres reed valve 1280 to outer rim 1288 of cylinder 1284 and a non-adhesive portion 1291 that forms flap 1282. In operation, flap 1282 of reed valve 1280 flexes about a pivot line 1283. Pivot line 1283 defines the border between adhesive portion 1290 and non-adhesive portion 1291. In the example embodiment illustrated, outer rim 1288 of cylinder 1284 includes a pair of locating posts 1292 extending outward therefrom away from end wall 206 and adhesive portion 1290 of reed valve 1280 includes a corresponding pair of cutouts 1293 that align with and receive locating posts 1292 when reed valve 1280 is mounted on cylinder 1284. The engagement between locating posts 1292 and cutouts 1293 aligns reed valve 1280 relative to cylinder 1284 during assembly.

With reference to FIGS. 17 and 18, outer rim 1288 of cylinder 1284 includes a tapered end surface 1289 that tapers toward end wall 206 in the non-adhesive portion 1291 of reed valve 1280. A gap 1294 is formed between the tapered portion of end surface 1289 and flap 1282 of reed valve 1280 when flap 1282 is in its normal operating position, in a substantially straight orientation as shown in FIG. 17. Outside air is generally free to pass through gap 1294 to enter inlet opening 1222 when the air pressure inside reservoir 202 is less than the atmospheric air pressure. However, when the air flow into inlet opening 1222 exceeds a threshold amount, flap 1282 flexes across outer rim 1288 and seals against end surface 1289 thereby blocking air flow to inlet opening 1222. For example, when a large influx of outside air begins to enter inlet opening 1222, such as during vigorous shaking of toner cartridge 200, the temporary decrease in air pressure near the outlet opening of vent 1220 causes flap 1282 block air flow to inlet opening 1222. In this manner, reed valve 1280 permits the entry of outside air into vent 1220 during normal, low air flow conditions such as when the air pressure in reservoir 202 decreases as toner cartridge 200 feeds toner to imaging unit 300 but reed valve 1280 prevents a large influx of air into vent 1220. The conditions that cause flap 1282 to block inlet opening 1222 may be adjusted by varying such factors as the rigidity of flap 1282, the geometry of end surface 1289 and the size of gap 1294.

FIG. 18 shows cylinder 1284 with reed valve 1280 removed. As shown, inlet opening 1222 is positioned in cylinder 1284. The example embodiment illustrated includes an air filter 1228, which may be composed of open cell foam, positioned in cylinder 1284 surrounding inlet opening 1222 to prevent any small amount of toner that leaks into vent 1220 from escaping. In one embodiment, air filter 1228 is adhered to end wall 206 by an adhesive on the back side of air filter 1228.

Figure 19:
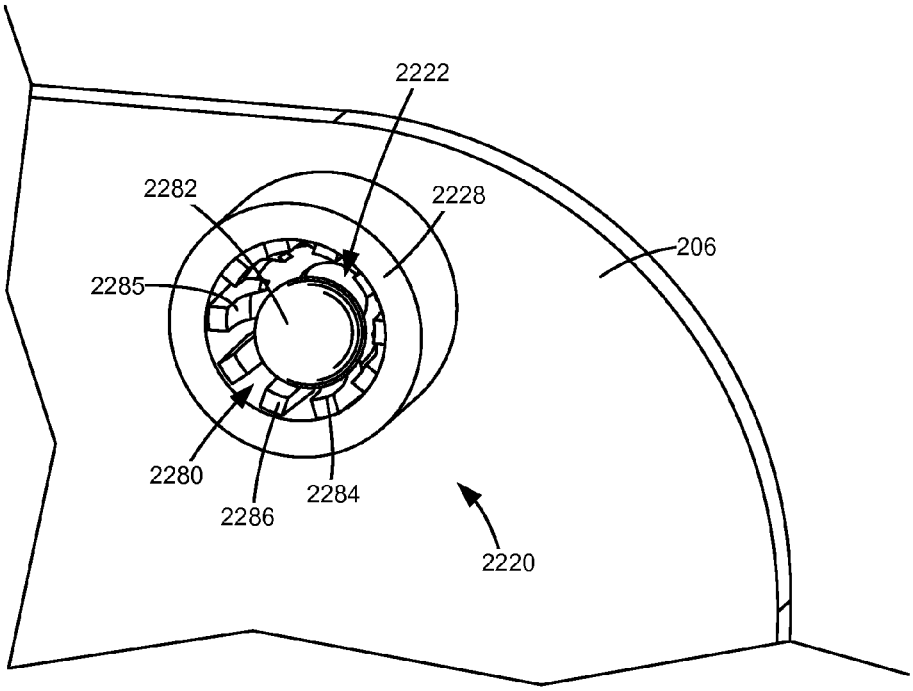
FIG. 19 is a perspective view of an outer side of an end wall of a toner cartridge according to a fourth example embodiment having a ball check valve showing a ball spaced away from an air inlet.
Figure 20:
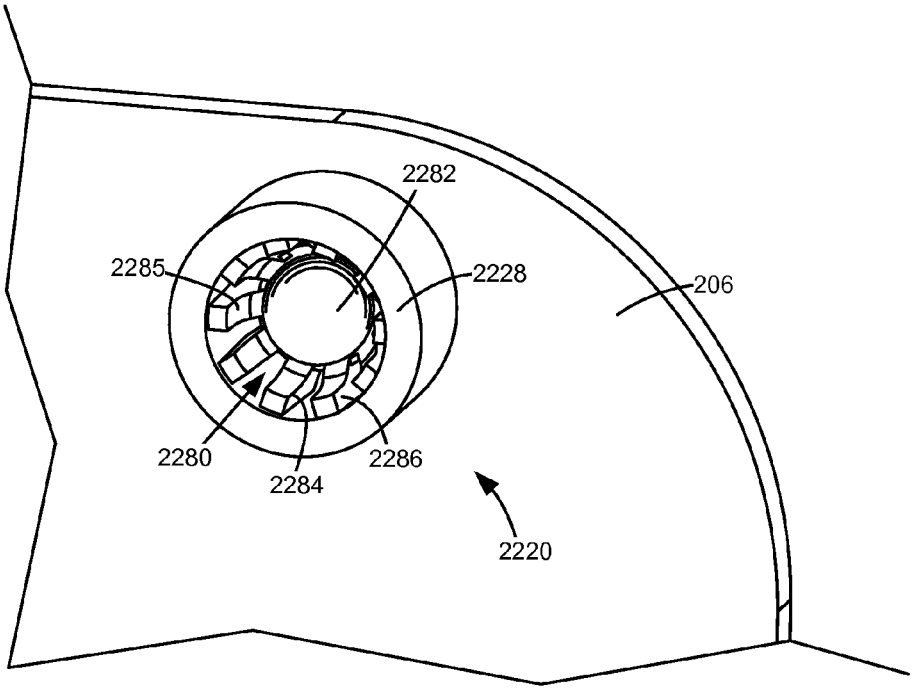
FIG. 20 is a perspective view of the outer side of the end wall shown in FIG. 19 showing the ball blocking the air inlet.

FIGS. 19 and 20 illustrate another example embodiment of a vent 2220 that permits the introduction of outside air into reservoir 202. Vent 2220 includes an inlet opening 2222 positioned on the outer side of end wall 206. Like vents 220, 220' and 1220 discussed above, vent 2220 includes an outlet opening (not shown) in an interior portion of reservoir 202 and a one-way valve, such as a reed valve, that permits air to enter reservoir 202 from outside toner cartridge 200 and prevents air and toner from exiting reservoir 202 through vent 2220. Vent 2220 also includes a check valve that limits the flow of air through vent 2220 into reservoir 202 in order to prevent a large influx of outside air through vent 2220. In the embodiment illustrated, vent 2220 includes a ball check valve 2280 positioned over inlet opening 2222. Ball check valve 2280 includes a spherical ball 2282 constrained by a cage 2284 on the outer surface of end wall 206 next to inlet opening 2222. Cage 2284 is positioned so as to be substantially horizontal when toner cartridge 200 is installed in image forming device 100. Cage 2284 includes a constraining surface 2285 in position to contact ball 2282. Constraining surface 2285 has a circular cross-section that increases in diameter as constraining surface 2285 moves away from inlet opening 2222. In the example embodiment illustrated, cage 2284 is formed by a series of circumferentially spaced ribs 2286 that flare radially outward with respect to inlet opening 2222 as ribs 2286 extend away from inlet opening 2222 and end wall 206. In this embodiment, constraining surface 2285 is formed on inner radial surfaces of ribs 2286 with respect to inlet opening 2222. The distal end of cage 2284 away from end wall 206 includes a cap that prevents ball 2282 from escaping cage 2284. For example, in the embodiment illustrated, an inner surface of end cap 208 is positioned against the distal ends of ribs 2286 to prevent ball 2282 from escaping cage 2284.

As shown in FIG. 19, ball 2282 tends to roll along a bottom portion of constraining surface 2285 away from inlet opening 2222 due to the outward flaring of constraining surface 2285. As a result, ball 2282 is normally spaced from inlet opening 2222 permitting outside air to pass over ball 2282 and into inlet opening 2222 when the air pressure inside reservoir 202 is less than the atmospheric air pressure. However, as shown in FIG. 20, when the air flow into inlet opening 2222 exceeds a threshold amount, ball 2282 covers inlet opening 2222 thereby blocking air flow to inlet opening 2222. For example, when a large influx of outside air begins to enter inlet opening 2222, such as may occur during vigorous shaking of toner cartridge 200, the temporary decrease in air pressure near the outlet opening of vent 2220 causes ball 2282 to cover inlet opening 2222 thereby blocking air flow to inlet opening 2222. In this manner, ball check valve 2280 permits the entry of outside air into vent 2220 during normal, low air flow conditions such as when the air pressure in reservoir 202 decreases as toner cartridge 200 feeds toner to imaging unit 300 but ball check valve 2280 prevents a large influx of air into vent 2220. The conditions that cause ball 2282 to block inlet opening 2222 may be adjusted by varying such factors as the size of ball 2282, the weight of ball 2282, the geometry of cage 2284 and the distance ball 2282 is allowed to roll away from inlet opening 2222 during normal operating conditions.

Further, where the outlet opening of vent 2220 is positioned on the inner side of end wall 206, the shaking motion that may tend to shift toner away from the outlet opening of vent 2220 (thereby creating a low pressure condition near the outlet opening of vent 2220) is along a lengthwise direction 203 (FIG. 4) of toner cartridge 200, in a direction from end wall 207 to end wall 206. In the embodiment illustrated, movement of toner cartridge 200 in this direction also tends to move ball 2282 toward inlet opening 2222 to cover inlet opening 2222 and block air flow to inlet opening 2222 thereby promoting ball check valve 2280 to close when a low pressure condition is created near the outlet opening of vent 2220 due to the shaking of toner cartridge 200. Similarly, flap 1282 of reed valve 1280 may be weighted to encourage flap 1282 to cover inlet opening 1222 when toner cartridge 200 is shaken in a direction that creates a low pressure condition near the outlet opening of vent 1220.

In one embodiment, vent 2220 includes an air filter 2228 positioned at inlet opening 2222 to collect any small amount of toner that leaks into vent 2220. In one embodiment, air filter 2228 is composed of open cell foam. In the embodiment shown, air filter 2228 is positioned around cage 2284 and is sandwiched between the outer side of end wall 206 and the inner side of end cap 208.

Figure 21:
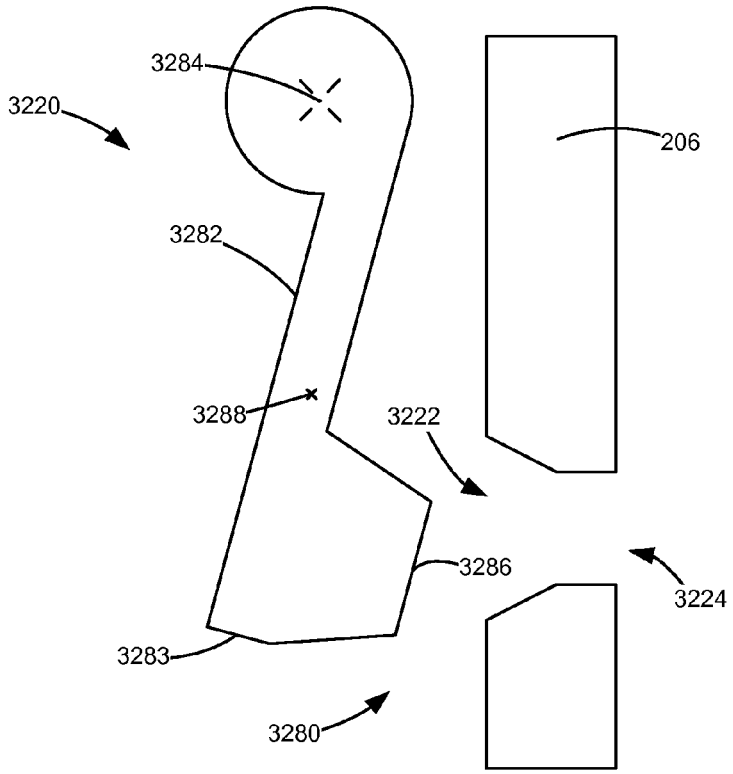
FIG. 21 is a schematic diagram of an end wall of a toner cartridge according to a fifth embodiment having a pendulum check valve showing the pendulum check valve spaced away from an air inlet.
Figure 22:
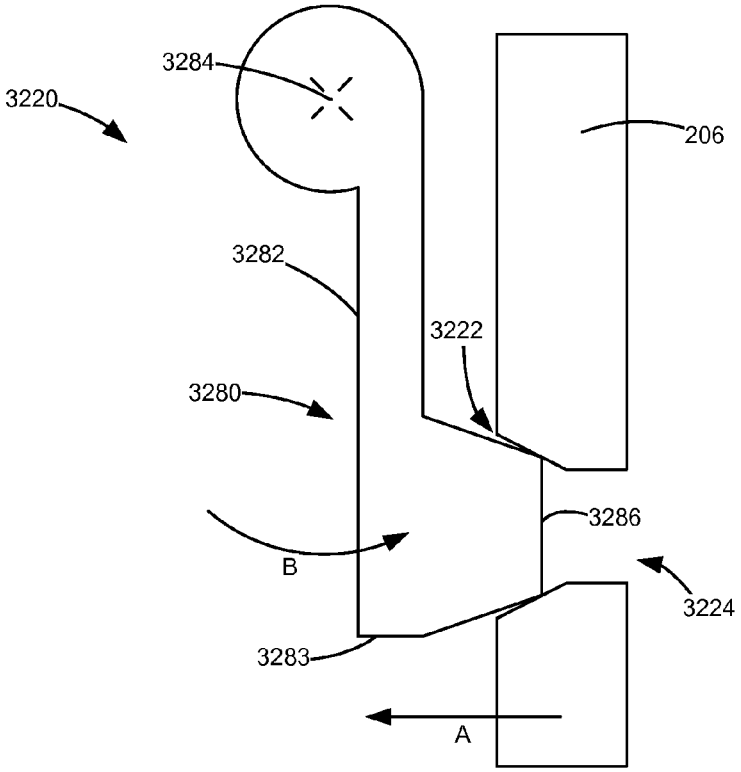
FIG. 22 is a schematic diagram of the end wall shown in FIG. 21 showing the pendulum check valve blocking the air inlet.

FIGS. 21 and 22 illustrate an example embodiment of a vent 3220 that permits the introduction of outside air into reservoir 202. Vent 3220 includes an inlet opening 3222 positioned on the outer side of end wall 206. Vent 3220 also includes an outlet opening 3224 in an interior portion of reservoir 202 and a one-way valve (not shown), such as a reed valve, that permits air to enter reservoir 202 from outside toner cartridge 200 and prevents air and toner from exiting reservoir 202 through vent 3220. Vent 3220 also includes a check valve that limits the flow of air through vent 3220 into reservoir 202 in order to prevent a large influx of outside air through vent 3220. In the embodiment illustrated, vent 3220 includes a pendulum check valve 3280 positioned on the outer side of end wall 206. Pendulum check valve 3280 includes an arm 3282 pivotally mounted to the outer side of end wall 206 about a pivot point 3284. A distal end 3283 of arm 3282 includes a stopper 3286 that is aligned with inlet opening 3222 in the swing path of arm 3282. Pendulum check valve 3280 is positioned so that the shaking movement of toner cartridge 200 in a direction that tends to move toner away from outlet opening 3224 creating a low pressure condition near outlet opening 3224 (as indicated by arrow A in FIG. 22) also tends to cause arm 3282 to pivot about pivot point 3284 (counterclockwise as viewed in FIGS. 21 and 22 and indicated by arrow B in FIG. 22) from the position shown in FIG. 21 spaced away from inlet opening 3222 to the position shown in FIG. 22 where stopper 3286 blocks air flow to inlet opening 3222. In one embodiment as shown in FIG. 21, the center of gravity 3288 of arm 3282 and pivot point 3284 are positioned so that when toner cartridge 200 is in its installed position in the image forming device with center of gravity 3288 vertically aligned with pivot point 3284 due to gravity, stopper 3286 is spaced away from inlet opening 3222 so that air is free to enter inlet opening 3222.

Although inlet openings 1222, 2222 and 3222 are illustrated positioned on end wall 206 in the example embodiment illustrated, it will be appreciated that inlet openings 1222, 2222 and 3222 may be positioned at any suitable location on toner cartridge 200 including, for example, on cylindrical wall 205. Further, while example vents 1220, 2220 and 3220 include reed valve 1280, ball check valve 2280 and pendulum check valve 3280, respectively, it will be appreciated that any suitable check valve may be used as desired.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments. For example, aspects of vent 230 may be combined with aspects of vent 230', etc.

The invention claimed is:

1. A toner cartridge for an electrophotographic image forming device, comprising:

a housing having a reservoir for storing toner;

a first vent having an inlet opening positioned to receive air from outside the housing, an outlet opening positioned to exit the received air into the reservoir, and a one-way valve that permits airflow through the first vent from the inlet opening to the outlet opening and prevents airflow through the first vent from the outlet opening to the inlet opening; and a check valve that limits airflow through the first vent from the inlet opening to the outlet opening.

2. The toner cartridge of claim 1, wherein the check valve includes an air flow limiting filter.

3. The toner cartridge of claim 1, wherein the check valve is open in a normal operating position of the check valve permitting airflow through the first vent from the inlet opening to the outlet opening and the check valve closes when the airflow exceeds a threshold amount preventing airflow through the first vent from the inlet opening to the outlet opening.

4. The toner cartridge of claim 3, wherein the check valve is open to the inlet opening in the normal operating position of the check valve permitting air to enter the inlet opening and closes the inlet opening when the airflow exceeds the threshold amount.

5. The toner cartridge of claim 3, wherein the check valve includes a reed valve having a flap that is open in a normal operating position of the flap permitting airflow through the first vent from the inlet opening to the outlet opening and that closes when the airflow exceeds the threshold amount preventing airflow through the first vent from the inlet opening to the outlet opening.

6. The toner cartridge of claim 5, further comprising a barrier on an outer surface of the housing surrounding the inlet opening and having an opening to the inlet opening, the flap of the reed valve extends across the opening of the barrier and a rim around the opening of the barrier includes a tapered end surface, a gap is formed between the flap and a portion of the tapered end surface when the flap is in the normal operating position of the flap permitting airflow to the inlet opening and the flap seals against the opening of the barrier when the airflow exceeds the threshold amount.

7. The toner cartridge of claim 3, wherein the check valve includes a ball check valve that is open in a normal operating position of the ball check valve permitting airflow through the first vent from the inlet opening to the outlet opening and that closes when the airflow exceeds the threshold amount preventing airflow through the first vent from the inlet opening to the outlet opening.

8. The toner cartridge of claim 1, further comprising:

an outlet port positioned on the housing for transferring toner out of the toner cartridge; and a second vent having an inlet opening positioned adjacent to the outlet port to receive air at the outlet port, an outlet opening positioned to exit the air received at the outlet port into the reservoir, and a one-way valve that permits airflow through the second vent from the inlet opening of the second vent to the outlet opening of the second vent and prevents airflow through the second vent from the outlet opening of the second vent to the inlet opening of the second vent.

9. The toner cartridge of claim 8, further comprising an auger positioned above the outlet port for moving toner from the reservoir to the outlet port, the inlet opening of the second vent being positioned on an inner side of a wall of the housing next to the auger.

10. The toner cartridge of claim 9, further comprising a deflector separating the inlet opening of the second vent and a portion of the auger from toner stored in the reservoir.

11. A toner cartridge for an electrophotographic image forming device, comprising:

a housing having a reservoir for storing toner;

a first vent having an inlet opening on an outer side of a wall of the housing positioned to receive air from outside the housing, an outlet opening on an inner side of the wall of the housing positioned to exit the received air into the reservoir, and a one-way valve that permits airflow through the first vent from the inlet opening to the outlet opening and prevents airflow through the first vent from the outlet opening to the inlet opening; and a check valve that is open to the inlet opening in a normal operating position of the check valve permitting air to enter the inlet opening and the check valve closes the inlet opening when the airflow through the first vent from the inlet opening to the outlet opening exceeds a threshold amount.

12. The toner cartridge of claim 11, wherein the check valve includes a reed valve having a flap that is open in a normal operating position of the flap permitting air to enter the inlet opening and that closes the inlet opening when the airflow exceeds the threshold amount.

13. The toner cartridge of claim 12, further comprising a barrier surrounding the inlet opening on the outer side of the wall of the housing and having an opening to the inlet opening, the flap of the reed valve extends across the opening of the barrier and a rim around the opening of the barrier includes a tapered end surface, a gap is formed between the flap and a portion of the tapered end surface when the flap is in the normal operating position of the flap permitting air to enter the inlet opening and the flap seals against the opening of the barrier when the airflow exceeds the threshold amount.

14. The toner cartridge of claim 11, wherein the check valve includes a ball check valve that is open in a normal operating position of the ball check valve permitting air to enter the inlet opening and that closes the inlet opening when the airflow exceeds the threshold amount.

15. The toner cartridge of claim 11, further comprising:

an outlet port positioned on the housing for transferring toner out of the toner cartridge; and a second vent having an inlet opening positioned adjacent to the outlet port to receive air at the outlet port, an outlet opening positioned to exit the air received at the outlet port into the reservoir, and a one-way valve that permits airflow through the second vent from the inlet opening of the second vent to the outlet opening of the second vent and prevents airflow through the second vent from the outlet opening of the second vent to the inlet opening of the second vent.

16. The toner cartridge of claim 15, further comprising an auger positioned above the outlet port for moving toner from the reservoir to the outlet port, the inlet opening of the second vent being positioned on the inner side of the wall of the housing next to the auger.

17. The toner cartridge of claim 16, further comprising a deflector separating the inlet opening of the second vent and a portion of the auger from toner stored in the reservoir.

* * * * *